US011749521B2

(12) United States Patent
Petty

(10) Patent No.: US 11,749,521 B2
(45) Date of Patent: Sep. 5, 2023

(54) MULTI-CONFIGURATION LAMP MANIPULATION TOOL

(71) Applicant: 2ULES, LLC, Spicewood, TX (US)

(72) Inventor: Barry F. Petty, Spicewood, TX (US)

(73) Assignee: 2ULES, LLC, Spicewood, TX (US)

( * ) Notice: Subject to any disclaimer, the term of this patent is extended or adjusted under 35 U.S.C. 154(b) by 197 days.

(21) Appl. No.: 17/156,342

(22) Filed: Jan. 22, 2021

(65) Prior Publication Data

US 2022/0238322 A1 Jul. 28, 2022

(51) Int. Cl.

| | |
|---|---|
| ***H01K 3/32*** | (2006.01) |
| ***H01J 9/00*** | (2006.01) |
| ***B25B 11/00*** | (2006.01) |
| ***B25B 21/00*** | (2006.01) |

(52) U.S. Cl.

CPC ..... *H01K 3/32* (2013.01); *B25B 11/007* (2013.01); *B25B 21/002* (2013.01); *H01J 9/003* (2013.01)

(58) Field of Classification Search

CPC ..... B25B 11/00; B25B 11/007; B25B 21/00; B25B 21/002; H01J 9/00; H01J 9/003; H01J 9/006; H01K 3/30; H01K 3/32

See application file for complete search history.

(56) References Cited

U.S. PATENT DOCUMENTS 2,637,587 A * 5/1953 Robinson ..... H01J 9/006 81/53.11
2,722,448 A 11/1955 Rudolf et al.
4,976,173 A * 12/1990 Yang ..... B25F 3/00 81/177.8
5,117,233 A 5/1992 Hamos et al.
5,148,723 A 9/1992 Newman et al.
5,904,387 A * 5/1999 Nagai ..... B65G 47/91 901/40
6,883,400 B2 4/2005 Sugano
7,143,668 B2 12/2006 Johnson et al.
7,234,734 B2 6/2007 Borwig et al.

(Continued)

OTHER PUBLICATIONS amazon.com, Schmalz FSG 52 NBR-55 G1/4-AG Bellows Suction Cup (Round), Accessed Jan. 22, 2021, <https://www.amazon.com/Schmalz-NBR-55-bellows-suction-round/dp/B06WLMTF9N>.

(Continued)

*Primary Examiner* — Robert J Scruggs
(74) *Attorney, Agent, or Firm* — Craige Thompson; Thompson Patent Law; Timothy D. Snowden

(57) ABSTRACT

Apparatus and associated methods relate to a lamp manipulation tool (LMT) having a bellows engaged within a container and fluidly connected to a vacuum source disposed in the container, the vacuum source being configured to apply a suction such that the bellows is releasably coupled to a lamp when the lamp occludes an aperture of the bellows. In an illustrative example, the bellows may have a first aperture into the bellows and a second aperture within the bellows. The first aperture may, for example, be larger than the second aperture. The vacuum source may, for example, be operated by a remote switch. The container may, for example, be coupled to a handle. Various embodiments may advantageously provide a single LMT that allows a user to manipulate a variety of lamps beyond the user's normal reach.

20 Claims, 7 Drawing Sheets

(56) References Cited

U.S. PATENT DOCUMENTS

| | | | | |
|---|---|---|---|---|
| 7,234,743 | B2 * | 6/2007 | Robinson | H01K 3/32 81/53.11 |
| 7,334,503 | B1 * | 2/2008 | Newman | A47L 9/244 81/53.11 |
| 7,631,579 | B2 | 12/2009 | Johnson et al. | |
| 7,896,098 | B2 * | 3/2011 | Suzuki | B25B 23/1475 173/4 |
| 7,913,345 | B2 | 3/2011 | Dayton et al. | |
| 8,783,136 | B2 | 7/2014 | Workman | |
| 10,371,360 | B2 | 8/2019 | Johnson et al. | |
| 2005/0088281 | A1 | 4/2005 | Rohrberg et al. | |
| 2007/0125202 | A1 * | 6/2007 | Johnson | H01K 3/32 81/53.11 |
| 2011/0061498 | A1 * | 3/2011 | Johnson | F21V 21/36 81/472 |

OTHER PUBLICATIONS

Eurotech, Bellow-Suction-Cup, Accessed Mar. 2020, <https://www.etvac.com/bellow-suction-cups>.

Eurotech Vertriebs GMBH, Catalogue of Vacuum Components, Jan. 2019, 276 pages, Geislingen Deutschland. <https://www.etvac.de/wp-content/uploads/2020/06/20200213_Gesamtkatalog_2020_low.pdf>.

Giraffe Sure Grip, Sure-Grip Light Bulb Changer, Jan. 2017, <http://www.giraffesuregrip.com/wp-content/uploads/2017/01/Giraffe-Sure-Grip-Inst-Manual.pdf>.

Schmalz, Suction Cup Shapes, Accessed Jan. 22, 2021, <https://www.schmalz.com/en/vacuum-knowledge/the-vacuum-system-and-its-components/vacuumsuction-cups/suction-cup-shapes/>.

* cited by examiner

MULTI-CONFIGURATION LAMP MANIPULATION TOOL

TECHNICAL FIELD

Various embodiments relate generally to lamp manipulation tools.

BACKGROUND

Humans, animals, and plants, as well as other creatures, may be highly responsive to light. A quantity (e.g., number of lumen-hours) of light per day experienced by a given creature may affect biorhythms and various physiological functions. Light color, temperature, position, and proximity may also determine the effect of light on a creature.

Artificial light may be provided by a variety of sources. Residential, agricultural, commercial, industrial, and medical facilities, for example, may all be provided with various luminaires. The luminaires may, for example, be installed at construction or retrofitted. Each luminaire may be provided with one or more lamps.

Various luminaires may be provided, for example, with replaceable lamps. The replaceable lamps may, for example, be powered by electrical energy. The lamps may, for example, be incandescent, fluorescent, halogen, LED, infrared, laser, or some combination thereof.

SUMMARY

Apparatus and associated methods relate to a lamp manipulation tool (LMT) having a bellows engaged within a container and fluidly connected to a vacuum source disposed in the container, the vacuum source being configured to apply a suction such that the bellows is releasably coupled to a lamp when the lamp occludes an aperture of the bellows. In an illustrative example, the bellows may have a first aperture into the bellows and a second aperture within the bellows. The first aperture may, for example, be larger than the second aperture. The vacuum source may, for example, be operated by a remote switch. The container may, for example, be coupled to a handle. Various embodiments may advantageously provide a single LMT that allows a user to manipulate a variety of lamps beyond the user's normal reach.

Various embodiments may achieve one or more advantages. For example, various embodiments may advantageously permit a user to manipulate a variety of lamps with a single bellows without requiring replacement or adjustment of the bellows. Various embodiments may advantageously allow a user to replace an out-of-reach light bulb without a ladder. Various embodiments may, for example, advantageously allow a user to manipulate a hot light bulb without touching it and/or waiting for it to cool. Various embodiments may advantageously allow a user, for example, to manipulate a light bulb without breaking the bulb by engaging the bulb with a flexible bellows.

Various embodiments may, for example, advantageously provide a user with a self-contained LMT such that the user may change a lamp without plugging in and manipulating a power cord to power the vacuum source. Various embodiments may advantageously allow a user to operate the LMT by a user's choice of handle, for example. Various embodiments with a releasably coupled handle may, for example, advantageously come apart for storage. Various embodiments may, for example, provide a locking element which may advantageously prevent rotation of a threadedly engaged handle during operation (e.g., rotation) of the LMT.

Various embodiments may advantageously allow a user to, for example, remotely operate the vacuum source. A user may, for example, advantageously position the LMT in a desired orientation and position before activating the vacuum source. Various embodiments may advantageously reduce inadvertent damage, for example, to a lamp and/or other objects while positioning the LMT. Various embodiments may advantageously, for example, extend a charge life of a battery.

Various embodiments may advantageously, for example, provide an increased amount of friction between the bellows and a target object when a suction is applied. Various embodiments may, for example, advantageously provide adjustable vacuum pressure to control a level of engagement between the bellows and a target object.

The details of various embodiments are set forth in the accompanying drawings and the description below. Other features and advantages will be apparent from the description and drawings, and from the claims.

BRIEF DESCRIPTION OF THE DRAWINGS

Like reference symbols in the various drawings indicate like elements.

DETAILED DESCRIPTION OF ILLUSTRATIVE EMBODIMENTS

To aid understanding, this document is organized as follows. First, to help introduce discussion of various embodiments, an exemplary lamp manipulation tool (LMT) 105 is introduced with reference to FIG. 1. Second, that introduction leads into a description with reference to FIGS. 2-7 of various exemplary implementations and embodiments of exemplary LMTs. Finally, the document discusses further embodiments, exemplary applications and aspects relating to LMTs.

Figure 1:
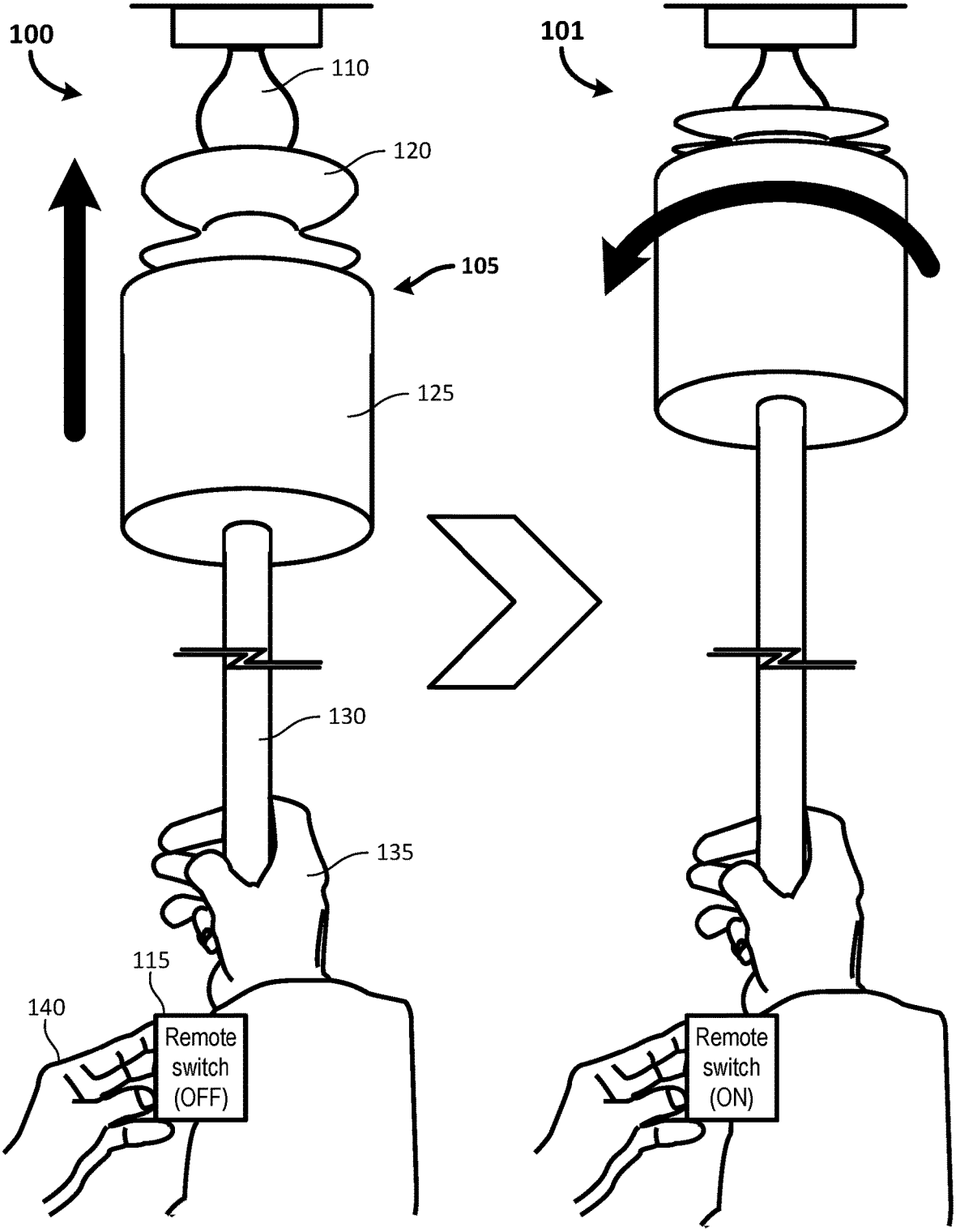
FIG. 1 depicts an exemplary lamp manipulation tool (LMT) employed in an illustrative use-case scenario with a remote control module.

FIG. 1 depicts an exemplary lamp manipulation tool (LMT) employed in an illustrative use-case scenario with a remote control module. In the exemplary lamp changing scenario 100, an LMT 105 is aligned with a lamp 110 and a remote control module 115 operated to engage the lamp as shown in scenario 101. A bellows 120 releasably couples to the lamp 110 when the remote control module 115 is activated. The bellows 120 is partially disposed within and engaged with a container 125. A handle 130 is coupled to the container 125. The handle 130 is held in a user's first hand 135. The user's second hand 140 holds and operates the remote control module 115. A vacuum source (not shown) is disposed within container 125 and pneumatically connected to the bellows 120. When the vacuum source is activated and the lamp 110 occludes an opening of the bellows 120, the LMT 105 is thereby releasably coupled to the lamp 110.

In the depicted example, the user aligns 100 the LMT 105 such that the lamp 110 occludes the bellows 120. The user operates the remote control module 115 to releasably couple the LMT 105 to the lamp 110 and operate the handle 130 in a first rotational direction (e.g., counterclockwise) to, for example, unscrew the lamp 110. Similarly, the user may install a new lamp by releasably coupling the lamp to the bellows 120 (e.g., by activating a vacuum source), lifting the lamp into place with the handle 130, and operating (e.g., turning via handle 130) the LMT 105 in a second rotational direction (e.g., clockwise) to install the new lamp. Accordingly, a user may advantageously, for example, employ the LMT 105 to replace a light bulb without a ladder. The LMT 105 may, for example, be self-contained. The user may advantageously, for example, manipulate a hot light bulb without touching the bulb. The user may advantageously, for example, manipulate a light bulb without breaking the bulb by engaging the bulb with a flexible bellows 120.

Figure 2:
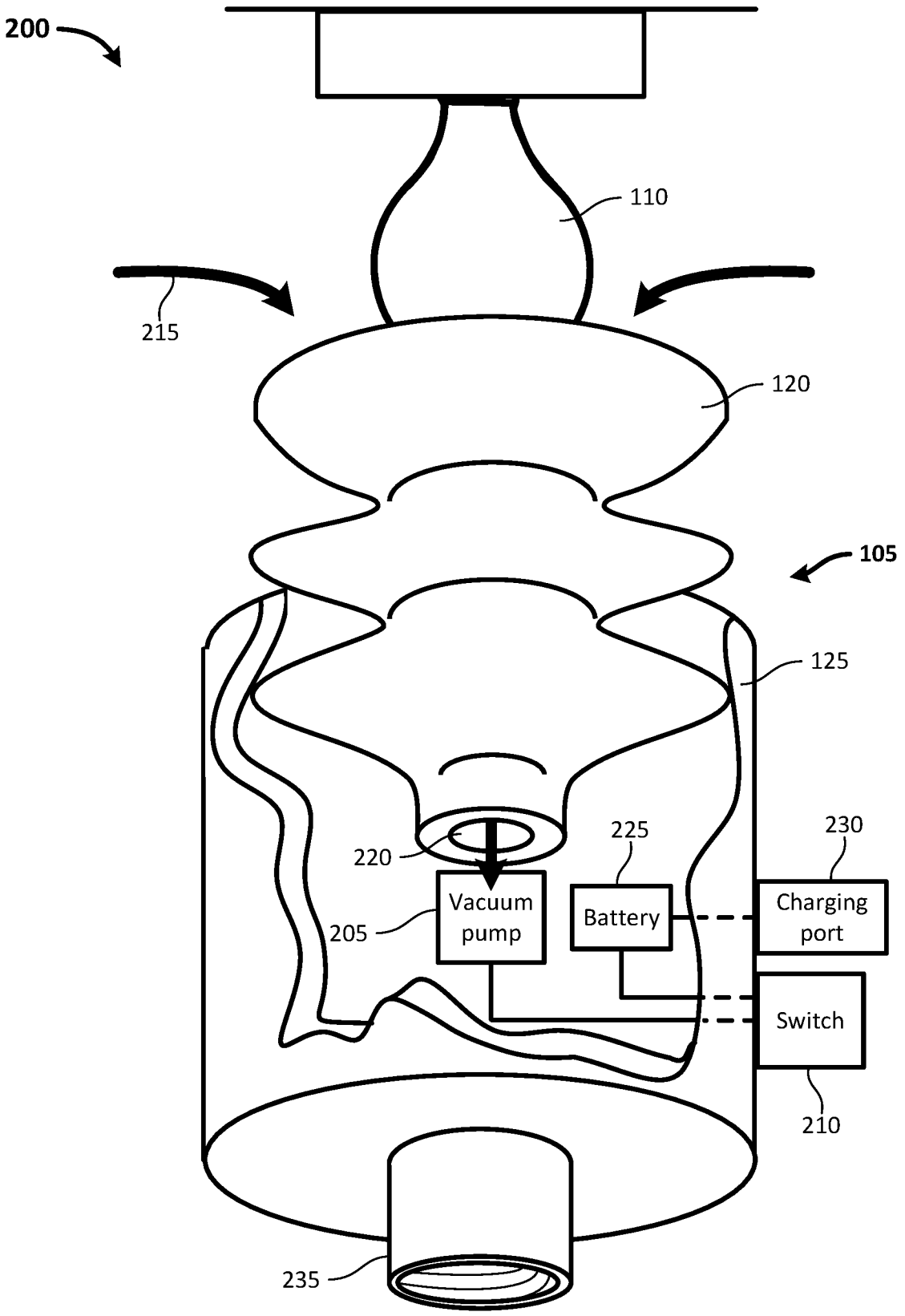
FIG. 2 depicts a perspective cutaway illustration of an exemplary internal configuration of the LMT of FIG. 1 with no remote control module.

FIG. 2 depicts a perspective cutaway illustration of an exemplary internal configuration of the LMT of FIG. 1 with no remote control module. In the depicted scenario 200, the bellows 120 is disposed within the container 125. A vacuum pump 205 is disposed within the container and pneumatically connected to the bellows 120. The vacuum pump 205 is electrically operated by a switch 210. Operation of the vacuum pump 205 draws air 215 through into the distal end of bellows 120 and through an aperture 220 in a proximal end of the bellows 120. Accordingly, when the lamp 110 occludes the distal end of the bellows 120, a suction is drawn within the bellows 120, which is thereby coupled to the lamp 110.

An energy storage module (e.g., a battery) 225 is electrically connected to the vacuum pump 205 via the switch 210 and may, for example, provide operational energy to the vacuum pump 205. The battery 225 is electrically connected to a charging port 230. The charging port 230 may, for example, be configured to electrically and releasably couple the battery 225 to an energy source (not shown) such as, by way of example and not limitation, a charger, a wall receptacle, an auxiliary energy storage apparatus, or some combination thereof. The charging port 230, the battery 225, or some combination thereof, may, for example, include a charge control circuit. Accordingly, the LMT 105 may, for example, advantageously be operated by a user to change a lamp 110 without requiring plugging in and manipulating a cord to power, for example, the vacuum pump 205.

The container 125 is provided with a coupling member 235. The coupling member 235 may, for example, be integrally and unitarily formed with the container 125. The coupling member 235 may, for example, receive and releasably couple to a handle 130. As depicted, the coupling member 235 may, by way of example and not limitation, be threaded. The threads may, for example, be standard ACME threads. Accordingly, a user may advantageously thread a handle such as, by way of example and not limitation, an existing handle (e.g., broom handle, mop handle, paint roller handle, extension handle), a purpose-built handle, or some combination thereof. In various embodiments, a locking element (e.g., a set screw), not shown, may engage the handle 130 when it is inserted into the coupling member 235. For example, the locking element may advantageously prevent a threadedly engaged handle 130 from disengaging from the container 125 during operation (e.g., rotation) of the LMT 105 by the handle 130.

Figure 3:
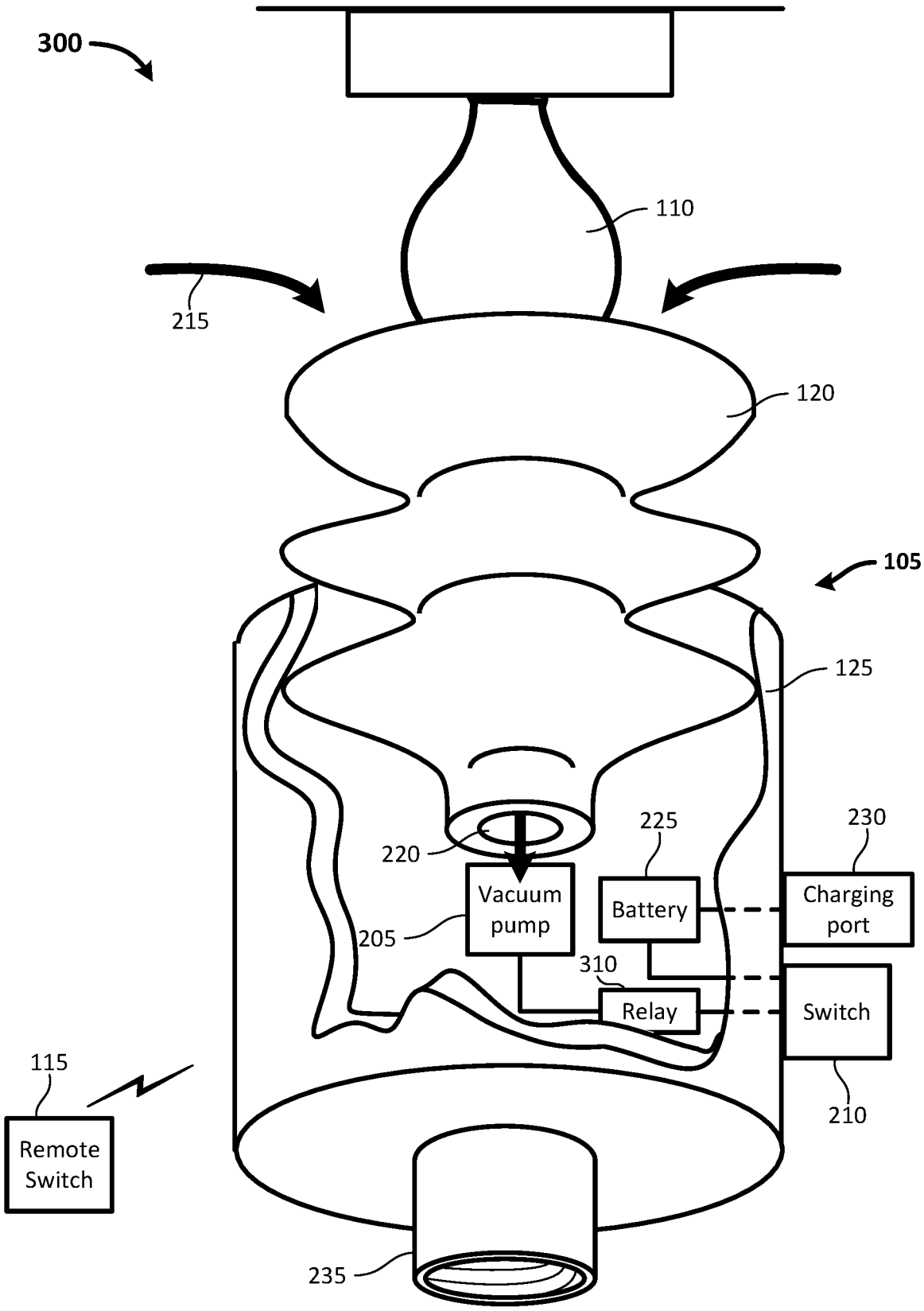
FIG. 3 depicts a perspective cutaway illustration of an exemplary internal configuration of the LMT of FIG. 1 with the remote control module.

FIG. 3 depicts a perspective cutaway illustration of an exemplary internal configuration of the LMT of FIG. 1 with the remote control module. In the depicted scenario 300, a relay 310 is electrically coupled to the switch 210. The relay 310 may, for example, be controlled by the remote control module 115 and the switch 210. A user may, for example, activate the switch 210 to selectively enable the relay 310 by selectively providing power to the relay 310 from the battery 225. The user may then, for example, operate the remote control module 115 and thereby operate the vacuum pump 205. Accordingly, the user may advantageously position the LMT 105 in a desired orientation and position before activating the vacuum pump 205. Accordingly, the user may advantageously avoid releasably coupling the bellows 120 to an object other than the lamp 110. Selectively operating the vacuum pump 205 may, for example, advantageously reduce inadvertent damage to the lamp 110 and/or other objects while positioning the LMT 105. Selectively operating the vacuum pump 205 by the remote control module 115 may advantageously, for example, extend a charge life of the battery 225. The switch 210 may advantageously enable a user to prolong a charge and/or useful life of the battery 225 by deactivating the wireless function of the relay 310 and thereby reducing or eliminating power draw when the LMT is not in use.

Figure 4B:
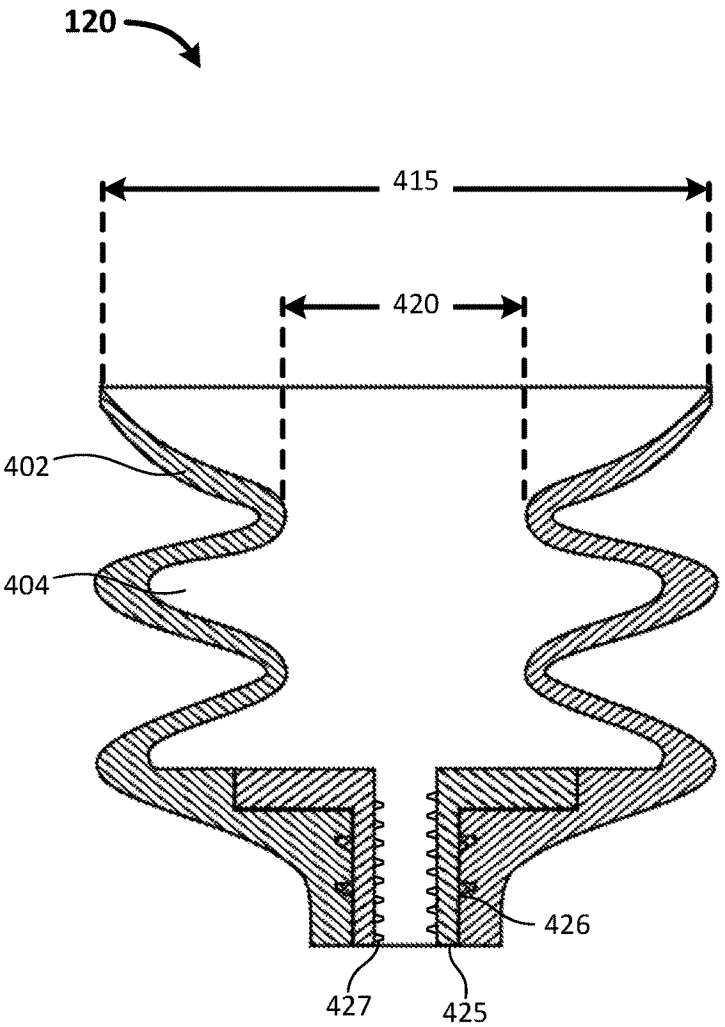
FIG. 4B depicts a cross-section plan view of the exemplary bellows of FIG. 4A.
Figure 4A:
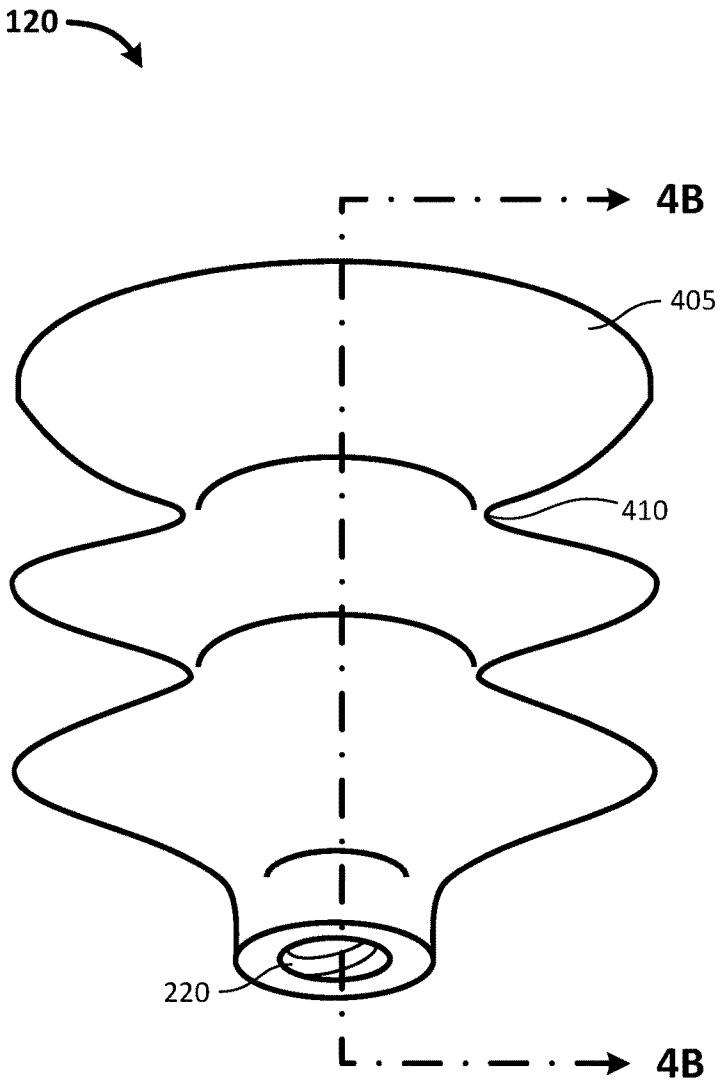
FIG. 4A depicts a perspective view of an exemplary bellows of the exemplary LMT of FIG. 1.

FIG. 4A depicts a perspective view of an exemplary bellows of the exemplary LMT of FIG. 1. FIG. 4B depicts a cross-section plan view of the exemplary bellows of FIG. 4A. The bellows 120 is defined by a flexible wall 402. The flexible wall 402 defines a cavity 404. The flexible wall 402 defines a first aperture 405 into the cavity 404 at the distal end of the bellows 120. The flexible wall further defines a second aperture 410 within the cavity 404 and proximal to the first aperture 405. As depicted, both the first aperture 405 and a second aperture 410 are annular. In various embodiments, the apertures may, by way of example and not limitation, be circular, elliptical, polygonal, or otherwise curvilinear.

The first aperture 405 is defined, in this depicted example, by first diameter 415. In this depicted example, the second aperture 410 is similarly defined by second diameter 420. As shown, the first diameter 415 is greater than the second diameter 420. In the depicted example, the wall 402 monotonically decreases in diameter from the first aperture 405 to the second aperture 420. In various embodiments a cross sectional area of the first aperture 405 is greater than a cross sectional area of the second aperture 410. In various embodiments, by way of example and not limitation, the first diameter 415 may be approximately 80 mm, less than 80 mm, or greater than 80 mm. In various embodiments, the second diameter 420 may be approximately 32 mm, less than 32 mm, or greater than 32 mm. In various embodiments, the cavity 404 may, by way of example and not limitation, be approximately 50 mm in height (from the first aperture to the top of a coupling element 425) in an un-collapsed configuration, less than 50 mm, or greater than 50 mm. In various embodiments, by way of example and not limitation, the wall may have a minimum thickness of approximately 2-3 mm (e.g., 2.3-2.7 mm, 2.5 mm), less than 2 mm, or greater than 3 mm.

The outlet aperture 220 at the proximal end of the bellows 120 is defined by the coupling element 425. The coupling element 425, as depicted, is provided with a plurality of engagement features 426 which engage with the bellows 120. For example, the engagement features may be ring barbs configured to be inserted into the bellows in one direction and resist movement in a reverse direction. In various embodiments, the wall 402 may, by way of example and not limitation, be molded over the coupling element 425, the coupling element 425 may be assembled with the wall 402, or some combination thereof.

The coupling element 425 may, for example, be releasably couplable to the vacuum source (e.g. vacuum pump 205). The coupling element 425 provides fluid communication between first cavity 404 and the vacuum pump 205. The coupling element 425 may, by way of example and not limitation, be provided with inner threads 427. For example, the coupling element 425 may be configured to threadedly receive an M8 fitting, another metric fitting, a national pipe taper fitting, a British pipe fitting, another threaded fitting, or some combination thereof. The coupling element 425 may, for example, be provided with a flange at a distal end. The flange may, by way of example and not limitation, with a maximum width of approximately 45 mm, less than 45 mm, or greater than 45 mm.

In the depicted example, the flexible wall 402 of the bellows 120 alternately increases and decreases in cross sectional area along a longitudinal axis running through the aperture 220, the first aperture 405, and the second aperture 410. Accordingly, the bellows may, for example, collapse along the longitudinal axis. For example, the bellows may longitudinally collapse when a suction is drawn on the cavity 404 by occlusion of at least one of the first aperture 405 and the second aperture 410 when the vacuum source (e.g. vacuum pump 205) is operated to apply a suction to the outlet aperture 220. When the bellows 120 collapses, a distance between the first aperture 405 and the second aperture 410 decreases. Accordingly, a greater portion of the flexible wall 402 may, by way of example and not limitation, come into contact with a target object occluding the selected aperture. An amount of friction between the bellows 120 and the target object may accordingly be advantageously increased. In various embodiments a vacuum pressure maybe adjusted to advantageously control a level of engagement between the bellows 120 and a target object.

Figure 5:
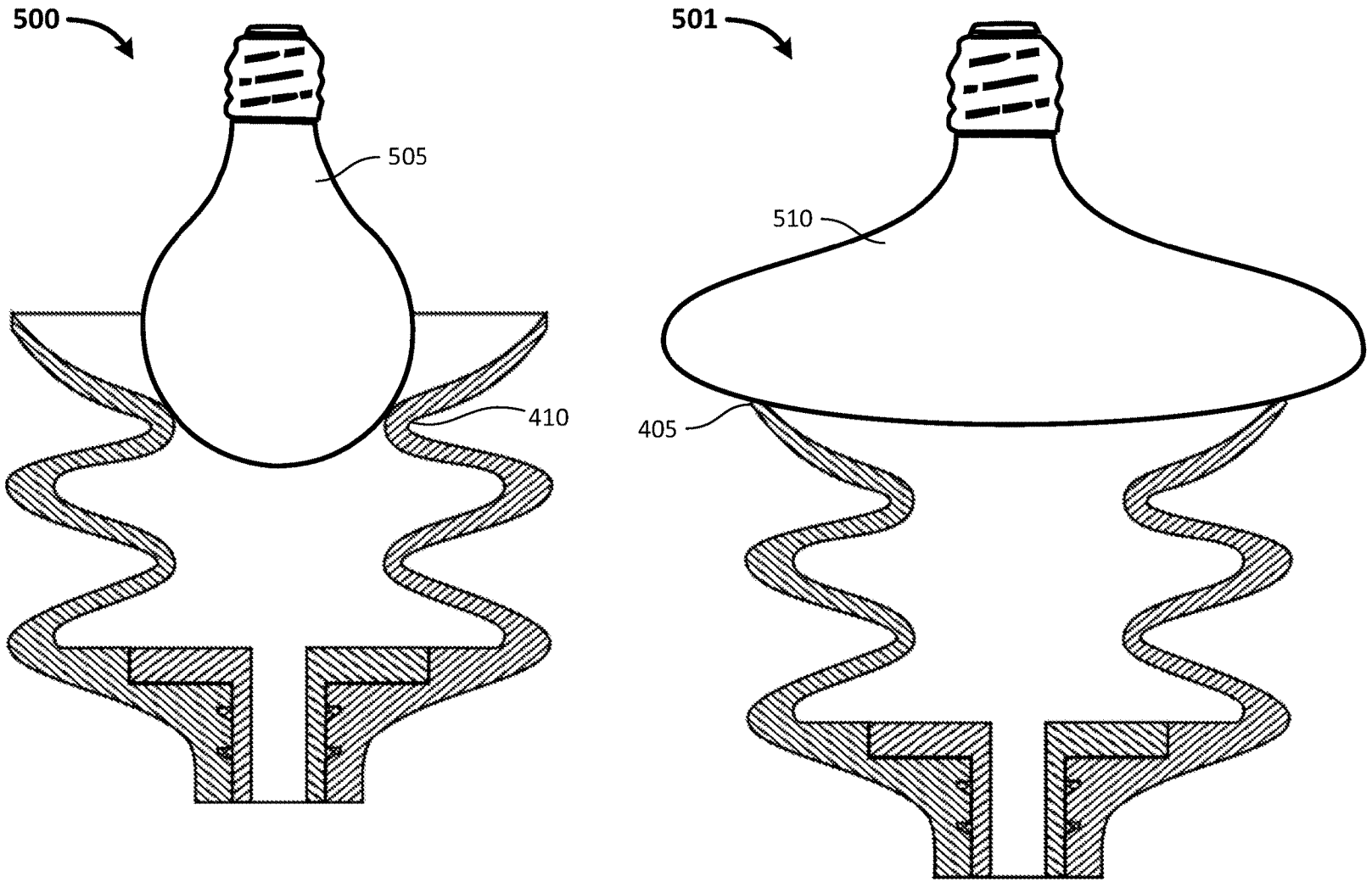
FIG. 5 depicts the exemplary bellows of FIG. 4A as applied to various replaceable lamps.

FIG. 5 depicts the exemplary bellows of FIG. 4A as applied to various replaceable lamps. In the depicted example 500 a bulbous lamp 505 is aligned to occlude the second aperture 410. The bulbous lamp (e.g., light bulb) 505 may, by way of example and not limitation, be an A19 (US) or A60 (metric) bulb. A cross sectional area of the second aperture 410 may, for example, advantageously be configured to engage a range of sizes of lamps. For example, the second aperture 410 may engage a bulbous portion of any light bulb having a major diameter greater than the diameter 420 of the second aperture 410.

In the depicted example 501 a substantially flat faced lamp 510 is aligned to occlude the first aperture 405. The lamp 510 may, for example, be a standard residential floodlight bulb. A cross sectional area of the first aperture 405 may, for example, advantageously be configured to engage a range of sizes of lamp faces. For example, the first aperture 405 may engage a face portion of any light bulb having a face with a diameter greater than the diameter 415 of the first aperture 405. Accordingly, a single bellows 120 may advantageously allow an LMT 105 to engage and operate a variety of shapes, sizes, and types of lamps. A user may advantageously manipulate a variety of lamps with a single bellows 120 without requiring replacement or adjustment of the bellows 120.

Figure 6:
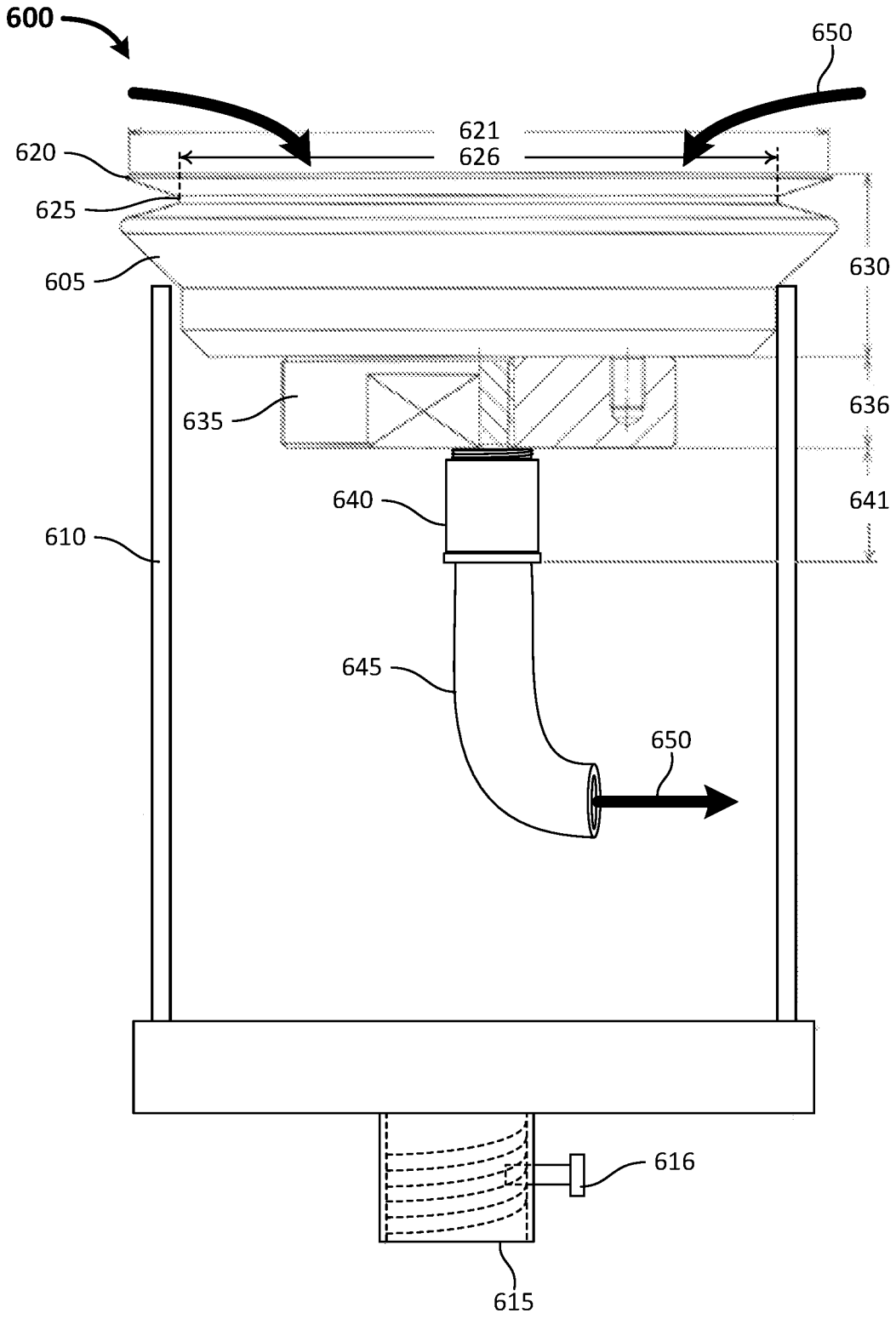
FIG. 6 depicts an exemplary LMT with an exemplary bellows and exemplary internal pneumatic configuration.

FIG. 6 depicts an exemplary LMT with an exemplary bellows and exemplary internal pneumatic configuration. An LMT 600 is provided with a bellows 605. The bellows 605 is partially disposed within and engaged with a container 610 shown in cross section. The container 610 is provided with a threaded coupler 615. By way of example and not limitation, the threaded coupler 615 may threadedly receive a handle (e.g., 130). For example, the coupler 615 may have internal threads (as depicted), external threads, or some combination thereof. In the depicted example, the threaded coupler 615 is provided with a locking element 616. The locking element 616 may, for example, be a set screw threadedly traversing a well of the coupler 615. The locking element may, for example, be tightened against a handle (e.g., 130) threadedly coupled into the coupler 615. The locking element 616 may advantageously prevent rotation of a handle relative to the coupler 615 and container 610.

The bellows 605 is provided with the first aperture 620 having a first diameter 621 and a second aperture 625 having a second diameter 626. As depicted, the first diameter 621 is greater than the second diameter 626. The first diameter 621 may, by way of example and not limitation, be approximately 80 mm, less than 80 mm, or greater than 80 mm. The bellows 120 has a height 630. By way of example and not limitation, the height 630 may be approximately 37 mm, less than 37 mm, or greater than 37 mm. The bellows 120 is further provided with a plenum section 635 having a height 636. By way of example and not limitation, the height 636 may be approximately 10.5 mm, less than 10.5 mm, or greater than 10.5 mm.

Attached to a proximal end of the plenum section 635 is a vacuum coupling element 640. The vacuum coupling element 640 is defined by a height 641. By way of example and not limitation, the height 641 may be 25 mm, less than 25 mm, or greater than 25 mm. Releasably coupled to the vacuum coupling element 640 is a fluid coupling member 645. Fluid coupling member 645 may, for example be a length of tubing (e.g., flexible, rigid) connected to the coupling element 640 (e.g., friction fit, compression-fit, barb-fit, threaded, adhered, molded). A vacuum source, not shown, is coupled to the bellows 605 via the fluid coupling member 645. When the vacuum source is activated, air 650 may be drawn into the bellow 605 through the first aperture 620, through the plenum section 635, through the coupling element 640, through the fluid coupling member 645 and thereby into the vacuum source. Accordingly, when at least one of the apertures 620 and 625 are occluded by a target object, the bellows 120 may thereby be releasably coupled to the target object. In various embodiments the fluid coupling member 645 may be provided with a relief aperture (not shown) operable to allow air to enter the fluid coupling member 645 at a controlled rate. The relief aperture may advantageously allow suction to be released once a vacuum source is deactivated and/or disengaged. In some embodiments, a relief aperture may be provided in one or more locations including a bellows, plenum, container wall, fitting, coupling member/element, or some combination thereof.

Figure 7:
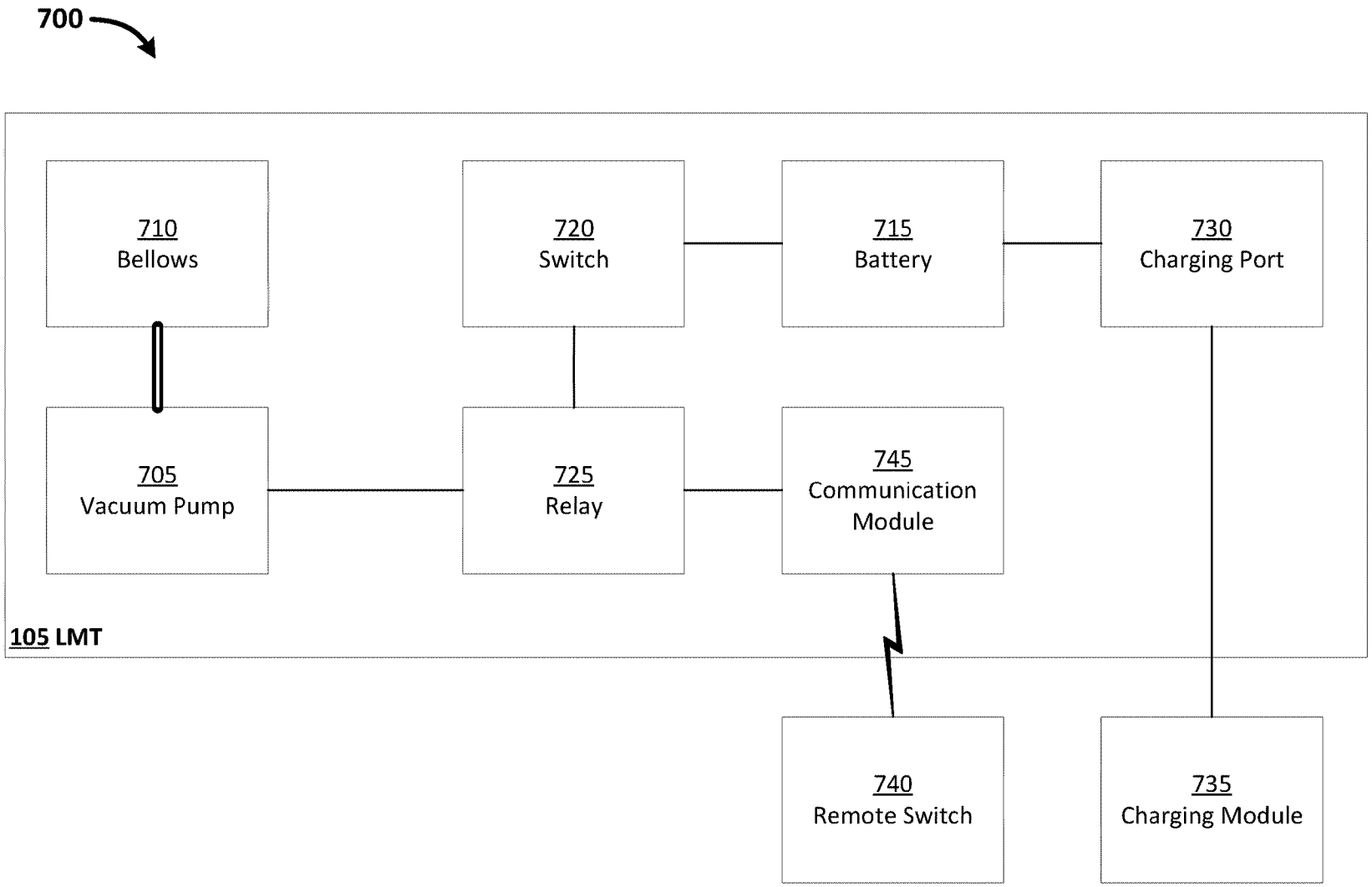
FIG. 7 depicts an exemplary block diagram of an exemplary LMT.

FIG. 7 depicts an exemplary block diagram of an exemplary LMT. In the depicted LMT system 700, a LMT 105 (e.g., as depicted in FIG. 3) is provided. The LMT 105 includes a vacuum pump 705 fluidly connected to a bellows 710. The vacuum pump 705 is operated by electrically connecting the vacuum pump 705 to an electrical storage module (e.g., battery) 715. The vacuum pump 705 is electrically connected to the electrical storage module 715 by a switch 720, by a relay 725 (e.g., electromechanical, solid state), or both. The electrical storage module 715 is electrically connected to a charging port 730. The charging port 730 electrically connects the electrical storage module 715 to a charging module 735. The charging module 735 may, for example, be a circuit configured to regulate electrical power received from a power source via the charging port 730 as required by the electrical storage module 715. As depicted, the charging module 735 is external to the LMT 105. In various embodiments the charging module 735 may be disposed at least partially within the LMT 105.

The relay 725 is wirelessly operated by a remote switch 740 via a communication module 745. The remote switch 740 may, for example, be a circuit configured to generate one or more predetermined wireless signals upon receiving input from a user. In various embodiments, the remote switch 740 may, for example, be an app running on a remote device (e.g., smartphone, tablet). The communication module 745 may be a circuit configured to operate the relay 725 based on wireless inputs received from the remote switch 740. The communication module 745 may, for example, be integral to the relay 725. As depicted, the switch 720 electrically connects the relay 725 to the battery. Accordingly, the relay 725 may be selectively enabled by a user such that the wireless function of the relay is only active when the user has activated the switch 720. The relay 725 controls power to the vacuum pump 705, such as by receiving a predetermined signal from remote switch 740 via communication module 745. In some embodiments, the switch 720 and relay 725 may, for example, be connected in parallel. Accordingly, a user may advantageously operate the vacuum pump 705 of the LMT system 700 even when the switch 720 is not in convenient reach of the user.

Although various embodiments have been described with reference to the figures, other embodiments are possible. For example, in various embodiments, bellows (e.g., 120, 605) may be constructed entirely or partially of a flexible material. The flexible material may, for example, be an elastomeric material. The material may, by way of example and not limitation, comprise silicone, polyurethane, rubber, or some combination thereof. The flexible material may, by way of example and not limitation, have a Shore A durometer of approximately 20-60. In some embodiments, the flexible material may have a Shore A durometer of approximately 30-50. In some embodiments, the flexible material may have a Shore A durometer of approximately 40.

In various embodiments a bellows (e.g., 120) may be coupled within a container (e.g., 125). By way of example and not limitation, the bellows may be threadedly coupled, adhesively coupled, fastened in by mechanical coupling elements (e.g., pins, screws, rivets, bolts), may be elastically coupled (e.g., stretched over or press fit into a coupling element(s)), or some combination thereof. The bellows may, for example, be replaceable in the field by a user. For example, a first bellows configured to fit one range of sizes and/or shapes of lamps may be replaced with a second bellows configured to fit another range of sizes and or shapes of lamps. By way of example and not limitation, the first bellows may be unscrewed from the container and the second bellows screwed into the container. In various embodiments, a means of coupling the bellows to the container may also provide fluid communication of the bellows to a vacuum source, or separate means of coupling the bellows to the container and fluidly coupling the bellows to the vacuum source may be provided. Accordingly, a single LMT (e.g., 105) may be advantageously used for a wider variety of lamps than a single bellows may otherwise permit.

In various embodiments, an outlet for the vacuum source may be provided. For example, the vacuum source may exhaust through an outlet aperture in the container (e.g., 125). The outlet aperture may, by way of example and not limitation, be provided as part of a means of coupling to a handle (e.g., 130) such as coupling member 235 in FIG. 2. In some embodiments, the vacuum source may, for example, exhaust around an outside of the bellows (e.g., 125). Accordingly, a vacuum source may advantageously continuously move air as necessary to maintain a desired level of suction pressure within a bellows.

In various embodiments, although exemplary LMTs (e.g., 105, 600, and 700) have been described with reference to the figures, other implementations may be deployed in various industrial, scientific, medical, commercial, and/or residential applications. For example, an LMT 105 may advantageously be used to releasably couple to and engage target objects other than lamps. Various embodiments may, by way of example and not limitation, be configured to advantageously manipulate mechanical and/or electrical components, camera positions (e.g., security cameras), wall hangings, and/or other desired objects.

In various embodiments, a bellows may, for example, be provided with at least one degree of freedom relative to a handle (e.g., via a knuckle, pivot joint, U-joint, ball and socket joint, telescoping pole). The degree(s) of freedom may, for example, be controllable by a user (e.g., via cables, linkage elements, remotely operated power actuators) to manipulate a position of a bellows (e.g., by manipulation of the container in which the bellows is engaged) into a desired position relative to a handle. Various such embodiments may, for example, advantageously allow a user to navigate around an obstacle, to engage a target object (e.g., lamps) not directly accessible by a straight LMT (e.g., in a chandelier or sconce), or some combination thereof. Various embodiments may be provided with a means of rotating the bellows (e.g., via the container in which the bellows is engaged) relative to the handle, for example. A means of rotating the bellows may include, by way of example and not limitation, a powered (e.g., electric, hydraulic, pneumatic) rotational actuator, a linkage configured to allow a user to manually rotate the bellows without rotating a handle by which the user is supporting the LMT, or some combination thereof. Accordingly, a user may advantageously rotate the bellows (e.g., to remove or install a lamp) without rotating the handle by which the user is supporting the LMT.

In various embodiments a bellows (e.g., 120) may be coupled within a container (e.g., 125) via an interference fit. For example, an outer diameter of the bellows may be slightly greater than an inner diameter of the container wall, such that when the bellows is fitted within the container, the bellows will resist being axially decoupled (e.g., pulled out). The interference fit of the bellows within the container may, for example, rotationally secure the bellows within the container such that when the container rotates (e.g., by a user rotating a handle 130 in an unscrewing or screwing motion), the bellows rotates with it. Accordingly, a user may advantageously manipulate a target object (e.g., a lamp 110) via manipulation of the bellows via the container. In various embodiments the bellows may, for example, be configured with an interference fit over the container, or over some portion of the container (e.g., an inner protruding wall).

In various embodiments a connection between a bellows (e.g., 120) and a vacuum source (e.g., the vacuum pump 205) may be mechanically decoupled from torsional, azimuthal, and/or axial forces that may impinge on a section of the bellows external to a container (e.g., 120). For example, the interference fit described previously may advantageously mechanically isolate a pneumatic coupling (e.g., 640 and/or 645 of FIG. 6, 220 of FIGS. 4A-B) of the bellows to a vacuum source from forces experienced by a portion of the bellows external to the container (e.g., during manipulation of a lamp 110). In various embodiments a bellows with an at least partially flexible wall may further permit mechanical isolation/decoupling of the pneumatic joint(s) and an external bellows portion. Accordingly, in various embodiments a combination of a rigid container, a flexible bellows, and/or the bellows being partially disposed and mechanically coupled (e.g., by an interference fit) within the container may advantageously provide mechanical decoupling of the external portion (e.g., including first aperture 405 and second aperture 410) from the pneumatic joint (e.g., 640 and/or 645 of FIG. 6, 220 of FIGS. 4A-B) and thereby may advantageously provide a more robust, durable pneumatic connection of the bellows and a vacuum source.

In various embodiments, some bypass circuits implementations may be controlled in response to signals from analog or digital components, which may be discrete, integrated, or a combination of each. Some embodiments may include programmed, programmable devices, or some combination thereof (e.g., PLAs, PLDs, ASICs, microcontroller, microprocessor), and may include one or more data stores (e.g., cell, register, block, page) that provide single or multi-level digital data storage capability, and which may be volatile, non-volatile, or some combination thereof. Some control functions may be implemented in hardware, software, firmware, or a combination of any of them.

Temporary auxiliary energy inputs may be received, for example, from chargeable or single use batteries, which may enable use in portable or remote applications. Some embodiments may operate with other DC voltage sources, such as, for example, one or more batteries with nominal capacity of 1.5V, 6V, 9V, 12V, other appropriate capacity, or some combination thereof. Alternating current (AC) inputs, which may be provided, for example from a 50/60 Hz power port, or from a portable electric generator, may be received via a rectifier and appropriate scaling. Provision for AC (e.g., sine wave, square wave, triangular wave) inputs may include a line frequency transformer to provide voltage step-up, voltage step-down, and/or isolation.

In various embodiments, other hardware and software may be provided to perform operations, such as network or other communications using one or more protocols, wireless (e.g., infrared, radiofrequency) communications, stored operational energy and power supplies (e.g., batteries), switching and/or linear power supply circuits, and the like. One or more communication interfaces may be provided in support, for example, of various operations.

In some implementations, one or more user-interface features may be custom configured to perform specific functions. Various embodiments may be implemented in a computer system that includes a graphical user interface. To provide for interaction with a user, some implementations may be implemented on a computer having a display device, such as a CRT (cathode ray tube) or LCD (liquid crystal display) monitor for displaying information to the user, a keyboard, and a pointing device, such as a mouse or a trackball by which the user can provide input to the computer.

In various implementations, the system may communicate using suitable communication methods, equipment, and techniques. For example, the system may communicate with compatible devices (e.g., devices capable of transferring data to and/or from the system) using point-to-point communication in which a message is transported directly from the source to the receiver over a dedicated physical link (e.g., fiber optic link, point-to-point wiring, daisy-chain). The components of the system may exchange information by any form or medium of analog or digital data communication, including broadcasting to devices that are coupled together by a communication network, for example, by using omni-directional radio frequency (RF) signals. Other implementations may transport messages characterized by high directivity, such as RF signals transmitted using directional (i.e., narrow beam) antennas or infrared signals that may optionally be used with focusing optics. Still other implementations are possible using appropriate interfaces and protocols such as, by way of example and not intended to be limiting, USB 2.0, Firewire, ATA/IDE, RS-232, RS-422, RS-485, 802.11 a/b/g, Wi-Fi, Ethernet, IrDA, FDDI (fiber distributed data interface), token-ring networks, multiplexing techniques based on frequency, time, or code division, or some combination thereof. Some implementations may optionally incorporate features such as error checking and correction (ECC) for data integrity, or security measures, such as encryption (e.g., WEP) and password protection.

In various embodiments, an LMT or some component(s) associated therewith may include Internet of Things (IoT) devices. IoT devices may include objects embedded with electronics, software, sensors, actuators, and network connectivity which enable these objects to collect and exchange data. IoT devices may be in-use with wired or wireless devices by sending data through an interface to another device. IoT devices may collect useful data and then autonomously flow the data between other devices.

Various examples of modules may be implemented using circuitry, including various electronic hardware. By way of example and not limitation, the hardware may include transistors, resistors, capacitors, switches, integrated circuits, other modules, or some combination thereof. In various examples, the modules may include analog logic, digital logic, discrete components, traces and/or memory circuits fabricated on a silicon substrate including various integrated circuits (e.g., FPGAs, ASICs), or some combination thereof. In some embodiments, the module(s) may involve execution of preprogrammed instructions, software executed by a processor, or some combination thereof. For example, various modules may involve both hardware and software.

A number of implementations have been described. Nevertheless, it will be understood that various modifications may be made. For example, advantageous results may be achieved if the steps of the disclosed techniques were performed in a different sequence, or if components of the disclosed systems were combined in a different manner, or if the components were supplemented with other components. Accordingly, other implementations are contemplated within the scope of the following claims.

What is claimed is:

1. A lamp manipulation apparatus comprising:

a bellows comprising a flexible first wall defining a first cavity, a first annular aperture into the first cavity at a distal end of the bellows, and a second annular aperture within the first cavity and proximal to the first aperture, wherein a cross-sectional area of the first aperture is greater than a cross-sectional area of the second aperture and a cross-sectional area of the first cavity monotonically decreases from the first aperture to the second aperture;

a container having a second wall defining a second cavity with an upper end and a lower end, wherein the bellows is at least partially disposed within the second cavity and the first wall of the bellows is engaged with the second wall of the container and at least one of a coupler and a handle at the lower end; and, a vacuum pump disposed within the second cavity between the upper end and the lower end and fluidly connected to the first cavity, wherein the vacuum pump is configured to apply a suction to the first cavity such that, when a removable lamp unit occludes at least one of the first aperture and the second aperture, a distance between the first aperture and the second aperture decreases and the bellows is releasably coupled to the lamp unit.

2. The apparatus of claim 1, further comprising:

an energy storage module electrically connected to the vacuum pump; and, a charging port electrically coupled to the energy storage module and configured to provide energy thereto when an energy source is releasably electrically coupled to the charging port.

3. The apparatus of claim 1, further comprising a switch module in electrical connection with the vacuum pump and configured to selectively operate the vacuum pump in response to an input from a user.

4. A lamp manipulation apparatus comprising:

a bellows comprising a flexible first wall defining a first cavity, the first cavity having a first aperture into the first cavity at a distal end of the bellows, and a second aperture within the first cavity and proximal to the first aperture;

a container having a second wall defining a second cavity with an upper end and a lower end, wherein the bellows is at least partially disposed within the second cavity and the first wall of the bellows is engaged with the second wall of the container and at least one of a coupler and a handle at the lower end; and, a vacuum source disposed within the second cavity between the upper end and the lower end and fluidly connected to the first cavity, wherein the vacuum source is configured to apply a suction to the first cavity such that, when a target object occludes at least one of the first aperture and the second aperture, the bellows is releasably coupled to the target object.

5. The apparatus of claim 4, wherein a cross-sectional area of the first aperture is greater than a cross-sectional area of the second aperture.

6. The apparatus of claim 4, wherein the flexible first wall of the bellows defines both the first aperture and the second aperture.

7. The apparatus of claim 6, wherein a cross-sectional area of the first cavity monotonically decreases from the first aperture to the second aperture.

8. The apparatus of claim 4, wherein the first aperture and the second aperture are annular.

9. The apparatus of claim 4, wherein the first aperture is configured to be occluded by at least a portion of the target object when the target object is a floodlamp having a face cross-sectional area greater than the cross-sectional area of the first aperture.

10. The apparatus of claim 4, wherein the second aperture is configured to be occluded by at least a portion of the target object when the target object is an A-series light bulb having a major diameter greater than a diameter of the second aperture.

11. The apparatus of claim 4, wherein a distance between the first aperture and the second aperture decreases when the suction is applied to the first cavity and at least one of the first aperture and the second aperture are occluded.

12. The apparatus of claim 4, wherein the bellows is provided with a coupler configured to threadedly engage with and fluidly seal to the container such that the first cavity and the second cavity are fluidly sealed.

13. The apparatus of claim 4, wherein the vacuum source is a vacuum pump.

14. The apparatus of claim 4, further comprising an energy storage module electrically connected to the vacuum pump.

15. The apparatus of claim 14, further comprising a charging port electrically coupled to the energy storage module and configured to provide energy thereto when an energy source is releasably electrically coupled to the charging port.

16. The apparatus of claim 4, further comprising a switch module in electrical connection with the vacuum pump and configured to selectively operate the vacuum source in response to an input from a user.

17. The apparatus of claim 16, wherein the switch module comprises a remote control module operably connected to the switch module and configured to receive the input from the user.

18. The apparatus of claim 4, the container comprising a releasable coupler in a proximal end, wherein the bellows is disposed in a distal end of the container.

19. A lamp manipulation apparatus comprising:

a bellows comprising a flexible first wall defining a first cavity, the first cavity having a first aperture into the first cavity at a distal end of the bellows, and a second aperture within the first cavity and proximal to the first aperture;

a container having a second wall defining a second cavity with an upper end and a lower end, wherein the bellows is at least partially disposed within the second cavity and the first wall of the bellows is engaged with the second wall of the container and at least one of a coupler and a handle at the lower end; and, means for applying a suction to the first cavity such that, when a removable lamp unit occludes at least one of the first aperture and the second aperture, the bellows is releasably coupled to the lamp unit, wherein the means for applying a suction is disposed within the second cavity between the upper end and the lower end.

20. The apparatus of claim 19, wherein:

a distance between the first aperture and the second aperture decreases when the suction is applied to the first cavity, the flexible first wall of the bellows defines both the first aperture and the second aperture, a first cross-sectional area of the first aperture is greater than a second cross-sectional area of the second aperture, and a cross-sectional area of the flexible first wall of the bellows monotonically decreases from the first aperture to the second aperture.

* * * * *